US006547678B2

(12) United States Patent
Barfield

(10) Patent No.: US 6,547,678 B2
(45) **Date of Patent: *Apr. 15, 2003**

(54) GOLF BALL DIMPLE STRUCTURES WITH VORTEX GENERATORS

(76) Inventor: Gilbert Barfield, 444 Mill River Rd. P.O. Box 871, Carrabelle, FL (US) 32322

( * ) Notice: Subject to any disclaimer, the term of this patent is extended or adjusted under 35 U.S.C. 154(b) by 0 days.

This patent is subject to a terminal disclaimer.

(21) Appl. No.: 09/977,628

(22) Filed: Oct. 15, 2001

(65) Prior Publication Data

US 2002/0025864 A1 Feb. 28, 2002

Related U.S. Application Data

(63) Continuation-in-part of application No. 09/426,397, filed on Oct. 25, 1999, now Pat. No. 6,315,686.

(51) Int. Cl.[7] ..... A63B 37/14
(52) U.S. Cl. ..... 473/383
(58) Field of Search ..... 473/378, 383, 473/384

(56) References Cited

U.S. PATENT DOCUMENTS 1,286,834 A 12/1918 Taylor
4,877,252 A 10/1989 Shaw
4,960,282 A 10/1990 Shaw
5,356,150 A 10/1994 Lavallee et al.
5,470,076 A 11/1995 Cadorniga
5,536,013 A 7/1996 Pocklington
5,547,197 A 8/1996 Pocklington
6,162,136 A * 12/2000 Aoyama ..... 473/383
6,315,686 B1 * 11/2001 Barfield ..... 473/378

* cited by examiner

*Primary Examiner*—Mark S. Graham
*Assistant Examiner*—Raeann Gordon
(74) *Attorney, Agent, or Firm*—John A. Kramer, Esq.; Holland & Bonzagni, P.C.

(57) ABSTRACT

A vortex generating golf ball dimple for producing a turbulent boundary layer on the surface of a golf ball during its flight is a composite of a plurality of overlapping smaller concave sections. Preferably, the dimple is a plurality of peripheral spherical sections overlapping a central spherical section to form a ridge-like polygon. The polygon, the top edge of which lies below the outer edges of the dimple, acts as a vortex generating structure within the dimple concavity for producing the turbulent boundary layer. Each pair of opposite or near opposite sides of the polygon has a common cross-sectional shape or structure. The aerodynamic characteristics of the cross-sectional structure are such that the turbulent boundary layer is formed about the dimple at even relatively low velocities without any unnecessary interference being produced at high velocities. Because the cross-sectional structure is seen across the dimple from a plurality of orientations, the boundary layer producing effects of the dimple are directionally independent.

17 Claims, 7 Drawing Sheets

GOLF BALL DIMPLE STRUCTURES WITH VORTEX GENERATORS

This is a continuation-in-part of U.S. patent application Ser. No. 09/426,397, filed Oct. 25, 1999, now U.S. Pat. No. 6,315,686.

FIELD OF THE INVENTION

The present invention relates to golf balls, and, more particularly, to golf ball dimples.

BACKGROUND OF THE INVENTION

It has long been known that the flight of a golf ball is dramatically improved if depressions or "dimples" are impressed on the surface of the golf ball sphere. Aerodynamic studies and fluid mechanics principles attribute this improvement to the fact that the surface roughness produced by the dimples create turbulence at the surface of the sphere and hence what is known as a turbulent boundary layer. This turbulent boundary layer decreases the aerodynamic drag of the ball, thus allowing it to travel much farther than a smooth ball.

With conventionally dimpled golf balls, the creation of a turbulent boundary layer is highly velocity dependent. This is illustrated in FIGS. 1–4, labeled as prior art, which consider the flow of air or fluid over the surface of a portion of a golf ball 20. FIG. 1 shows the cross section of a typical, spherically concave golf ball dimple 22 which would be on the surface of the golf ball 20. In FIG. 2, air 24 passes slowly over the dimple 22 of FIG. 1 in the direction as indicated by the arrows. The air 24 conforms to the shape of the dimple 22 at its surface and has insufficient velocity or direction change to create turbulence or vortices.

FIG. 3 is a view of the same dimple 22 with the air 24 passing over the surface at a high enough velocity such that the air 24 cannot conform to the shape of the dimple 22. Instead, the air 24 slams into the back wall of the dimple 22 and quickly changes direction. As it exits the dimple 22, the air 24 cannot quickly re-conform to the spherical surface 26 of the golf ball 20. This results in the generation of turbulence and vortices, and thus the creation of the turbulent boundary layer.

FIG. 4 is a view of the same dimple 22 with the air 24 passing over the dimple at an intermediate velocity. The air 24 cannot perfectly conform to the surface of the dimple 22, but is in much greater contact than the air in FIG. 3 where the velocity is higher. As the air 24 exits the dimple 22, its velocity is such that it soon re-conforms to the surface 26 of the golf ball 20. Since this is the case, a turbulent boundary layer cannot be maintained even though some turbulence is generated at the intersection of the trailing edge of the dimple and the surface of the sphere.

The number, size, shape, and depth of the dimples all have an influence on the amount of distance improvement a dimpled golf ball will exhibit. Specifically, as the depth, diameter, and number of the dimples is gradually increased, the frictional drag of the ball is increased by the surface roughness of the dimples, and the aerodynamic drag is decreased. Up to a certain point, the effect of the reduction in aerodynamic drag far exceeds the effect of the increase of the frictional drag, and the golf ball exhibits significant distance improvement. Once this point is reached, though, further increases in dimple volume results in decreasing distance performance. This is because there is an increase in the frictional drag and an increase in aerodynamic drag due to the thickness of the generated boundary layer.

Those skilled in the art of designing golf balls have long known that the ideal dimple for a golf ball would change its shape during the flight of the ball. The ball would have low surface roughness when the velocity was high and turbulence was easy to generate. The roughness would increase gradually as the velocity decreased so as to maintain a uniform boundary layer, and would again decrease gradually to lower surface roughness during the descent of the ball, when one of the drag components would tend to keep the ball in flight. Unfortunately, there is no existing technology which allows golf balls to have such a feature.

Many attempts have been made to simulate at least a portion of the aforementioned ideal dimple characteristics. While there have been some improvements, these have been very modest in nature.

For example, triangle- or hexagon-shaped dimples having sharp edges have been used on golf balls. While these sharp edges assist in generating vortices and turbulence, they are located at the surface of the sphere and are hence in the airflow during the entire flight of the ball. Their effect must therefore be regulated so as not to produce too much turbulence early on in the flight, making them ineffectual during later portions of the flight.

Other dimple shapes have also been proposed. U.S. Pat. No. 5,470,076 to Cadorniga discloses providing dimples inside dimples, wherein each dimple includes an outer concentric portion having a shallow spherical concavity and an inner concentric portion having a deeper spherical concavity, but these offer no projections in the airstream for generating vortices. Also, U.S. Pat. No. 5,536,013 to Pocklington discloses a toroidal dimple with a center projection extending up to the surface of the sphere. Since this projection reaches the surface of the sphere, it suffers from the same problems as the sharp edged dimples described above.

Turning now to the prior art shown in FIG. 5, U.S. Pat. No. 4,877,252 to Shaw discloses pairs of normal sized dimples 28, 30 that overlap by as much as twenty percent. A single projection 32 below the level of the golf ball surface 26 is formed where the two dimples 28, 30 overlap. Theoretically, during flight at intermediate velocities, air strikes the projection 32, further helping to create a turbulent boundary layer. However, because the dimples 28, 30 overlap by no more than twenty percent, they form a large area on the surface of the golf ball whose width is at least 1.8 times the diameter of a single dimple. This can be seen by comparing the indicated diameter D of the dimple 22 in FIG. 1 to the indicated diameter (1.8D) of the overlapping dimples 28, 30 in FIG. 5. Aerodynamically, the overlapping dimples 28, 30 in FIG. 5 will behave approximately as two independent dimples with only a slight improvement in flight characteristics. This is because the projection 32 is so far from the edges of the dimples 28, 30 that the air passing over the golf ball during flight will still have a chance to conform to the shape of the dimples even at relatively high velocities, e.g., as shown in FIG. 4.

U.S. Pat. No. 4,960,282, also to Shaw, discloses pairs or chains of dimples that preferably overlap one another by at least 0.02 inches (0.508 mm) or twenty percent. Although this disclosed structure potentially reduces the velocity at which a turbulent boundary layer is formed, it still does not provide enhanced flight characteristics at lower velocities. This is because the projection is still quite far from the edges of the dimples, and because the turbulent boundary layer producing effect of the overlapping pairs of dimples is highly directionally dependent. That is, with reference to FIG. 5, when air 24 flows in either of the directions indicated by the arrows, a turbulent boundary layer will potentially be formed, depending on the velocity of the golf ball 20 and the particular dimensions of the overlapping dimples. However, if the air flows along (instead of across) the projection 32 (e.g., normal to FIG. 5), no boundary layer effects will be produced.

Accordingly, it is a primary object of the present invention to produce a golf ball with unique dimples that overcomes the deficiencies of the prior art to increase the flight of the ball.

Another object is to provide golf ball dimples having a common cross-sectional structure wherein a turbulent boundary layer is formed at low, medium, and high velocities.

Yet another object is to provide golf ball dimples wherein the creation of a turbulent boundary layer is not dependent upon the direction air flows over the dimples.

Still another object is to provide golf ball dimples wherein a turbulent boundary layer can be produced without a resultant increase in frictional drag.

SUMMARY OF THE INVENTION

In order to solve the aforementioned problems and meet the stated objects, the present invention discloses a plurality of vortex generating golf ball dimples for producing a turbulent boundary layer on the surface of the golf ball during a longer portion of the golf ball's flight, without unnecessarily increasing the size of the boundary layer in the early portions of the flight. This results in the golf ball traveling a longer distance.

Each dimple is a composite of a plurality of overlapping smaller concave sections, with the dimple preferably being dimensioned to lie within a circumscribed circle having about the same diameter as a conventional dimple. The preferred embodiments of the dimple comprise a plurality of peripheral spherical sections overlapping a central spherical section to form a ridge-like polygon. The polygon, the top edge of which lies below the outer edges of the dimple, acts as a vortex generating structure within the dimple con-cavity for producing the turbulent boundary layer. In fact, each pair of opposite or near opposite sides of the polygon has a common cross-sectional shape or structure. The aerodynamic characteristics of the cross-sectional structure are such that the turbulent boundary layer is formed about the dimple at even relatively low velocities. Also, because the cross-sectional structure is seen across the dimple from a plurality of orientations, the boundary layer producing effects of the dimple are directionally independent.

To generate air vortices, and thus the turbulent boundary layer, the opposite or near opposite sides of the polygon act as spaced apart vortex generating projections extending up from the bottom of the dimple. At high velocities, because the projections lie below the outer edge of the dimple, air, which can only slightly conform to the shape of the dimple, passes over the projections and only hits the trailing edge of the dimple, as in a conventional spherical dimple. This provides sufficient air vortices to create a turbulent boundary layer, without the projections unnecessarily and detrimentally contributing. At intermediate velocities, the air conforms a bit more to the shape of the dimple, and vortices are created as the air encounters at least one of the projections. Although these vortices are not necessarily strong enough to create a boundary layer by themselves, when combined with the now less forceful vortices at the trailing edge of the dimple, they are sufficient. Finally, at low velocities, the air generally conforms to the shape of the dimple, and encounters both the projections. The resultant vortices are sufficient, when combined with the vortices at the trailing edge of the dimple, to create the turbulent boundary layer.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE PREFERRED EMBODIMENT

Figure 12:
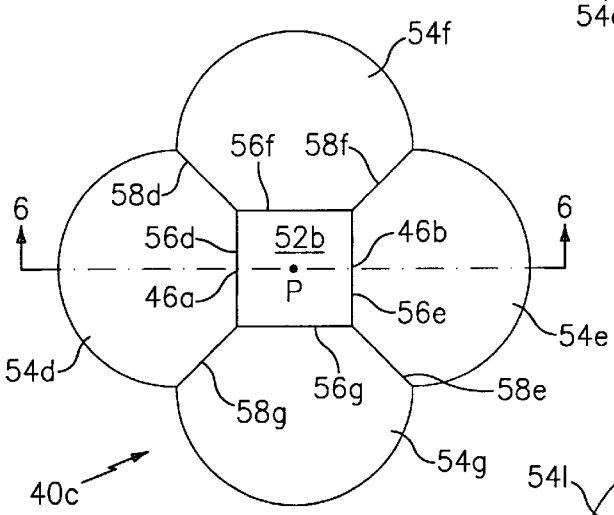
FIG. 12 is a top plan view of a third complex dimple having the cross-sectional structure shown in FIG. 6.
Figure 13:
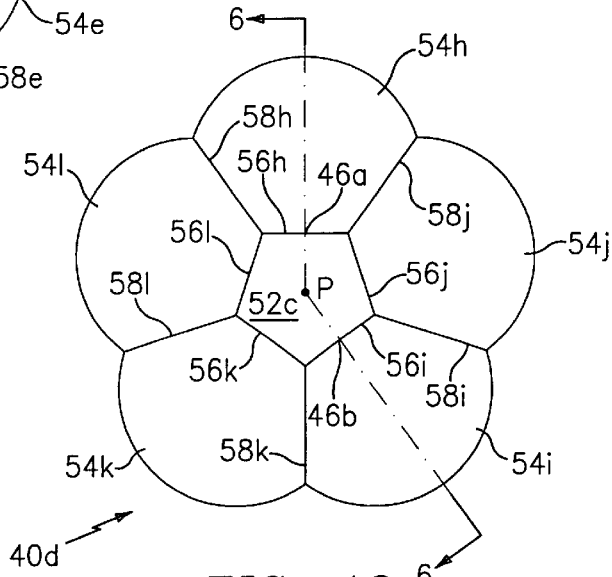
FIG. 13 is a top plan view of a fourth complex dimple having the cross-sectional structure shown in FIG. 6.
Figure 14:
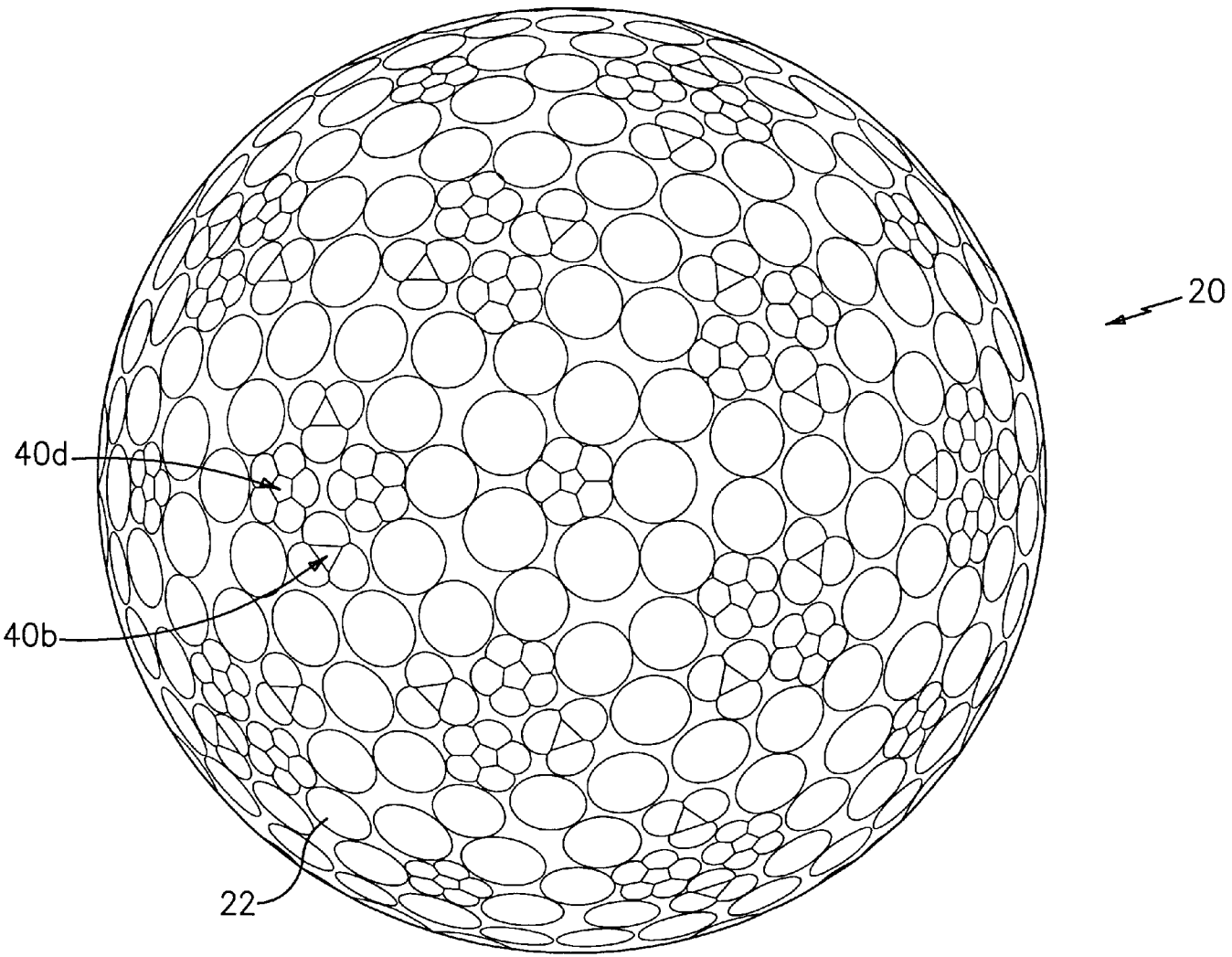
FIG. 14 is a perspective view of a golf ball incorporating the complex dimples shown in FIGS. 11 and 13.

Turning now to FIGS. 6–14, a preferred embodiment of a complex dimple cross-sectional structure 42 and complex dimples 40*a*–40*d* having the cross-sectional structure, according to the present invention, will now be given. When a golf ball 20 (e.g., as seen in FIG. 14) is provided with the dimples 40*a*–40*d*, it exhibits superior driving length. This is because the dimples have unique aerodynamic features 42, 48, 56*a*–56*l*, etc., as described below, that substantially improve and enhance the flight characteristics of the golf ball when it travels at low, medium, and high velocities after being struck by a golfer.

Various complex dimples 40*a*–40*d* of the present invention are shown in FIGS. 10–13, respectively. By "complex," it is meant that each dimple, as a result of being a composite of a plurality of smaller, spherically (or otherwise) shaped sections, has a vortex generating structure within the dimple concavity for producing a turbulent boundary layer. Each of the complex dimples 40*a*–40*d* has the cross-sectional structure 42 as shown in FIGS. 6–9. The aerodynamic characteristics of the cross-sectional structure 42, as explained below, are such that a turbulent boundary layer is formed about the complex dimples 40*a*–40*d* at even relatively low velocities. Thus, the golf ball 20 provided with a plurality of the complex dimples 40*a*–40*d* (see FIG. 14) will exhibit superior distance and flight characteristics.

Figure 1:
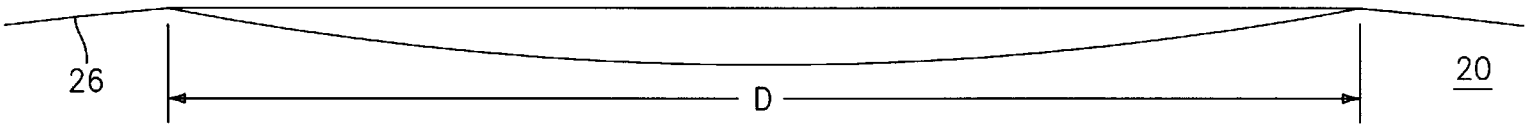
FIG. 1 (PRIOR ART)
FIG. 1 is a cross-sectional view of a golf ball dimple according to the prior art.
Figure 5:
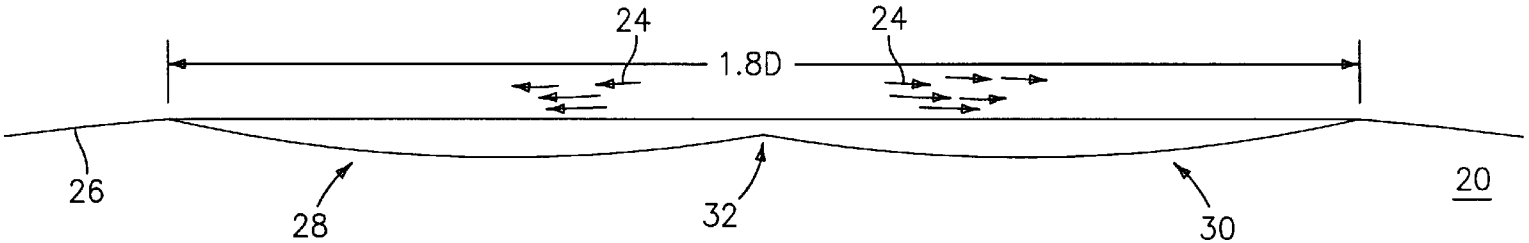
FIG. 5 (PRIOR ART)
FIG. 5 is a cross-sectional view of overlapping golf ball dimples according to the prior art.
Figure 6:
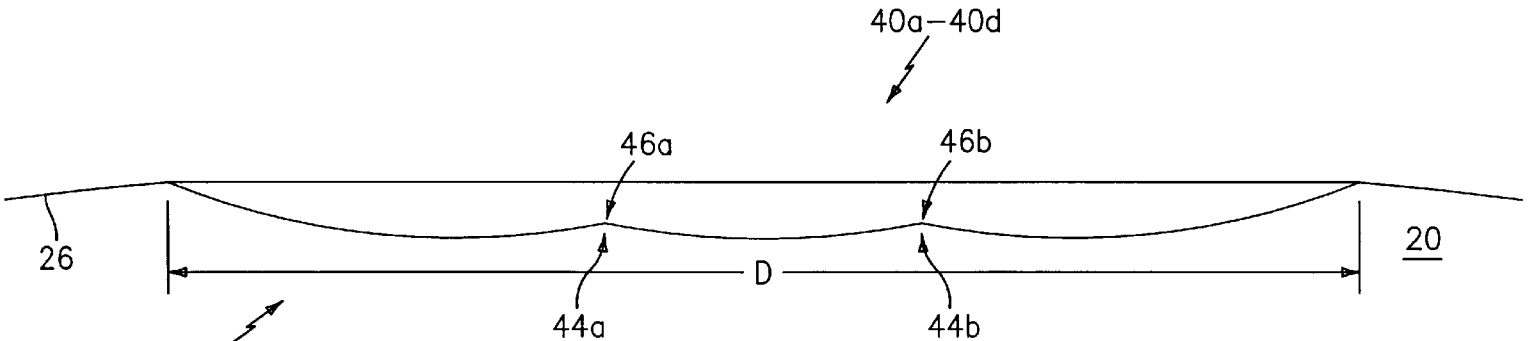
FIG. 6 is a view of a cross-sectional structure common to a plurality of complex dimples of the present invention and as shown in FIGS. 10–13.
Figure 2:
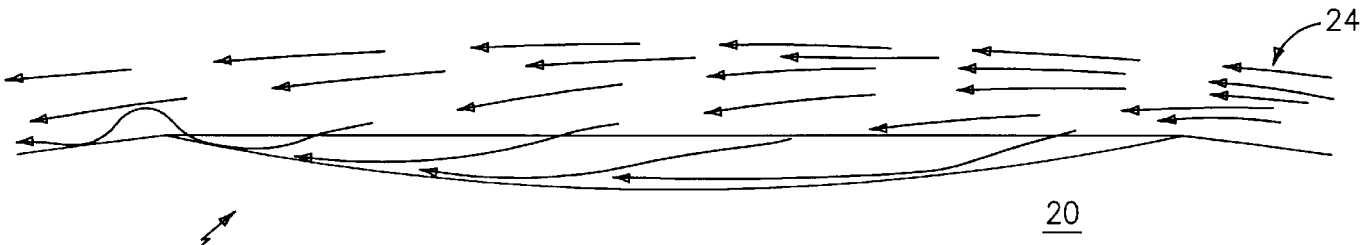
FIG. 2 (PRIOR ART)
FIG. 2 is a conceptual view of air flow over the dimple of FIG. 1 at a low velocity.

With reference to FIG. 6, the complex dimples 40*a*–40*d* are similar in cross-section (from the perspective shown) to the spherical dimple 22 in FIG. 1, to the extent that they both have the same diameter D and define an at least partially spherical concavity. However, the cross-sectional structure 42 of the complex dimples 40*a*–40*d* includes first and second edged projections or "vortex generators" 44*a*, 44*b* extending upwards from the dimple bottom. The tips or edges 46*a*, 46*b* of the vortex generators 44*a*, 44*b*, respectively, lie below a plane which would be coincident with the intersection of the outer edges of the dimple with the spherical surface 26 of the golf ball 20.

Figure 3:
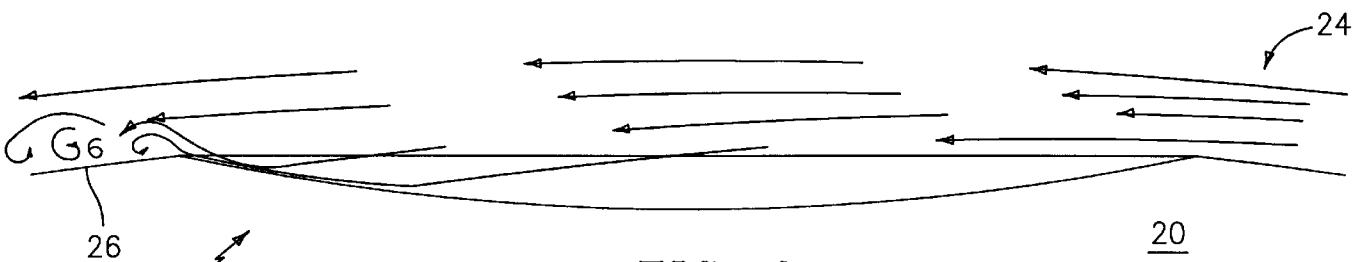
FIG. 3 (PRIOR ART)
FIG. 3 is a conceptual view of air flow over the dimple of FIG. 1 at a high velocity.
Figure 4:
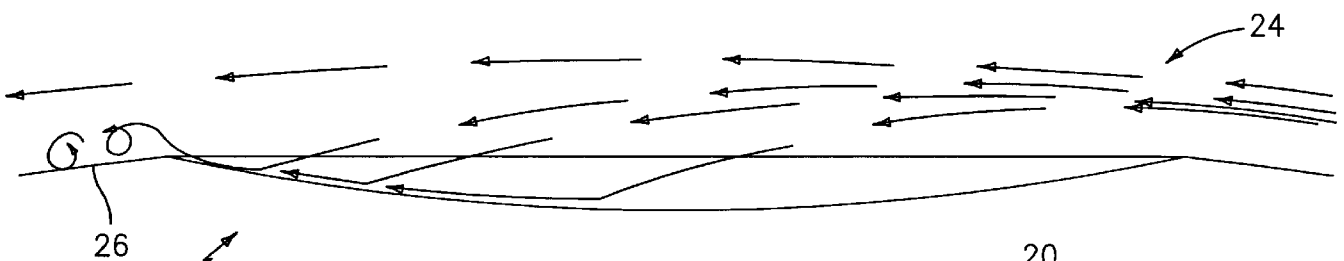
FIG. 4 (PRIOR ART)
FIG. 4 is a conceptual view of air flow over the dimple of FIG. 1 at an intermediate velocity.
Figure 7:
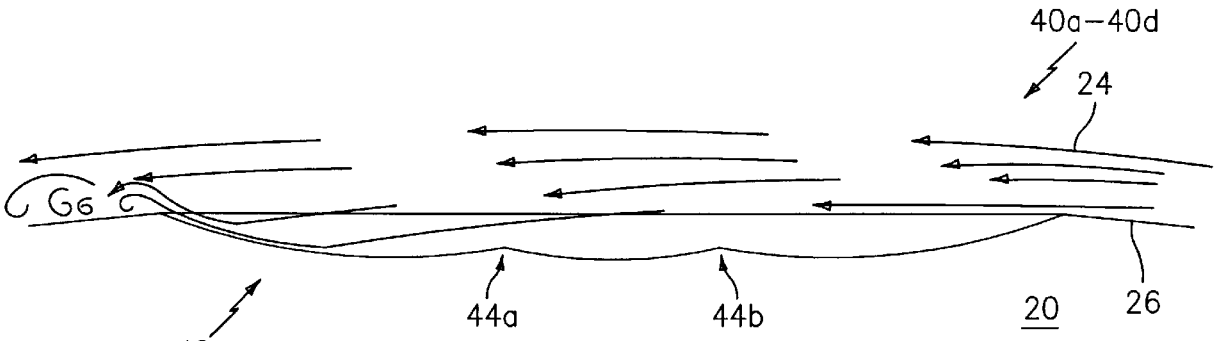
FIG. 7 is a conceptual view of air flow over the cross-sectional structure of FIG. 6 at a high velocity.

FIG. 7 shows the effect of the vortex generators 44*a*, 44*b* on the flow of air 24 across one of the complex dimples 40*a*–40*d* at high velocities. The air 24 passes over the vortex generators 44*a*, 44*b* and collides with the rear wall of the dimple without being affected by the vortex generators. Hence, the dimple will perform essentially the same as the conventional spherical dimple 22 in FIG. 3.

Figure 8:
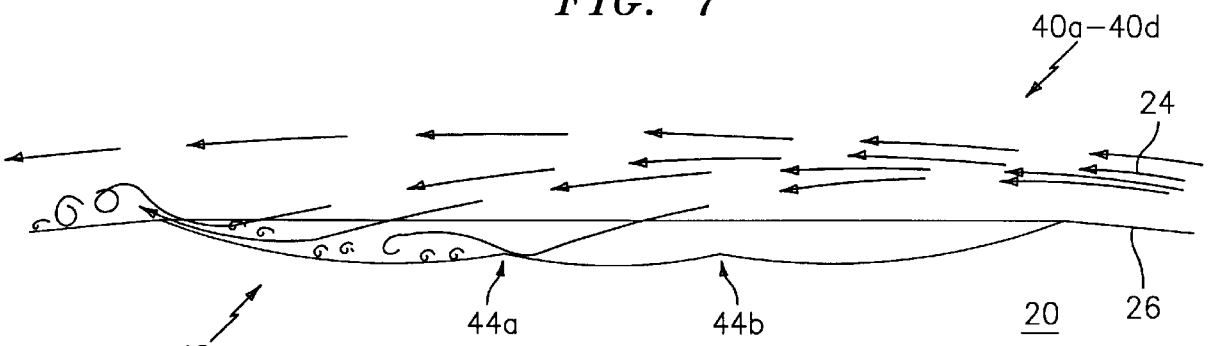
FIG. 8 is a conceptual view of air flow over the cross-sectional structure of FIG. 6 at an intermediate velocity.

FIG. 8 shows the cross-sectional structure 42 of FIG. 6 with air 24 passing over the dimple at an intermediate velocity. The air 24 hits the first vortex generator 44*a* and must quickly change direction. This abrupt change generates turbulence which is then additive to the turbulence created by the trailing edge of the dimple. Hence, a turbulent boundary layer is maintained at this velocity.

Figure 9:
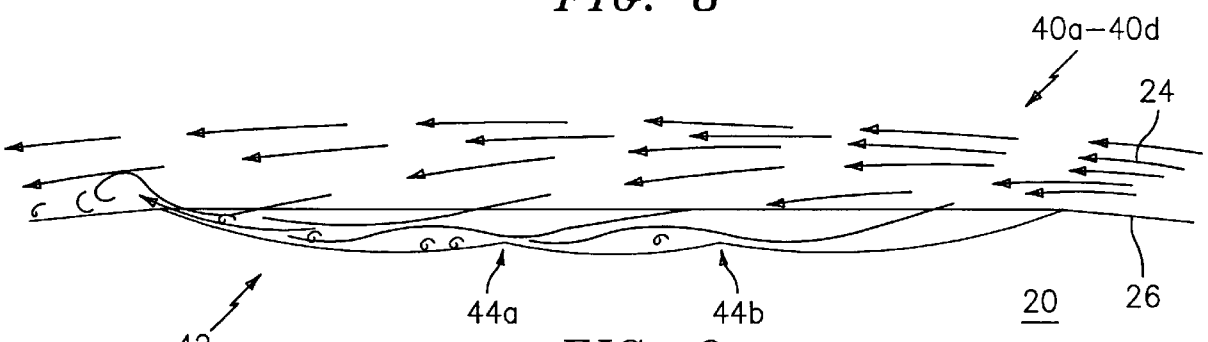
FIG. 9 is a conceptual view of air flow over the cross-sectional structure of FIG. 6 at a low velocity.

FIG. 9 shows the effect of air 24 passing over the vortex generators 44*a*, 44*b* at a low velocity. The air now strikes both of the vortex generators 44*a*, 44*b* at the bottom of the dimple. Even though the air 24 is traveling at low velocity, some turbulence is generated by the passage of the air 24 over the vortex generators 44*a*, 44*b* due to the air's necessary abrupt direction change.

As mentioned above, the top edges 46*a*, 46*b* of the vortex generators lie below the outer edge of the complex dimples 40*a*–40*d*. This is because a golf ball's velocity is constantly changing during flight, and the vortex generators are not needed in the early, high velocity portion of the flight. Note that if the vortex generators extended upwards as far as the outer edge of the dimple, frictional drag would be greatly increased without much additional benefit resulting from the stronger turbulent boundary layer.

Figure 10:
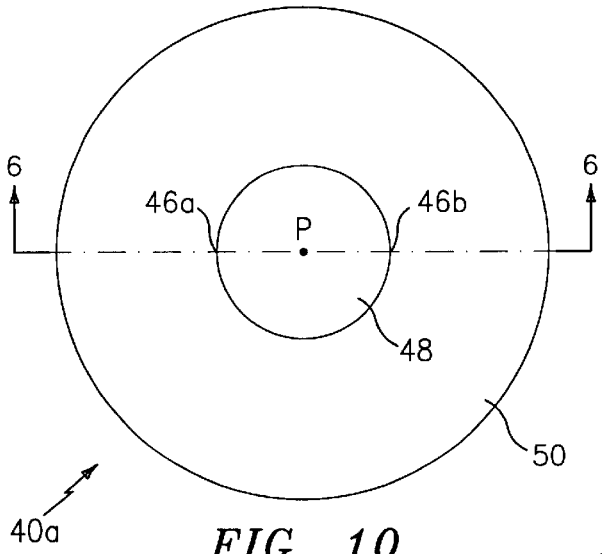
FIG. 10 is a top plan view of a first complex dimple having the cross-sectional structure shown in FIG. 6.

A first of the complex dimples 40*a* is shown in FIG. 10, and is the simplest construction available by which to provide the cross-sectional structure 42. The first dimple 40*a* is merely a spherical section 48 intersecting a toroidal section 50. However, vortex generators function best if their upper edges are substantially linear in nature rather than being arced. Therefore, the first complex dimple 40*a*, although functional in providing improved flight characteristics, is not preferred over the remaining complex dimples 40*b*–40*d* described herein.

Figure 11:
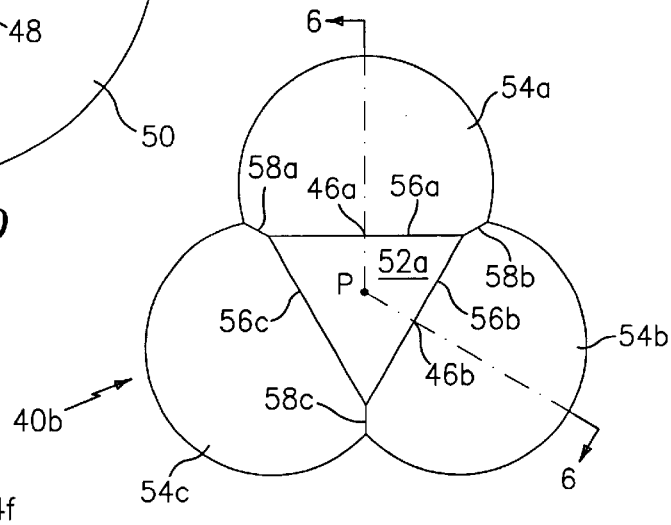
FIG. 11 is a top plan view of a second complex dimple having the cross-sectional structure shown in FIG. 6.

FIGS. 11–13 show second, third and fourth complex dimples 40*b*–40*d*, respectively. Each of these complex dimples comprises a plurality of spherical sections or concave walls which overlap in such a manner that the peripheral or outer sections 54*a*–54*l* (as applicable) form a polygon when they intersect a central section 52*a*–52*c* (as applicable.) This requires that all the peripheral sections be essentially the same distance radially from the center P of the central section 52*a*–52*c*, and further that the peripheral sections be essentially equally spaced (at equal angles) around the perimeter of the central section 52*a*–52*c*.

FIG. 11 shows the second complex dimple 40*b* created by the central spherical section 52*a* being intersected by three outer spherical sections 54*a*–54*c*. Specifically, the three outer spherical sections 54*a*–54*c* are symmetrically arranged 120° apart from one another about the center point P of the central spherical section 52*a*. This results in three linear segments 56*a*–56*c* forming a triangle and three additional linear segments 58*a*–58*c* which project from the apices of the formed triangle to the intersection of two adjacent outer spherical sections. Any two adjacent linear segments of the triangle (56*a*–56*b*, 56*b*–56*c*, or 56*c*–56*a*) provide the preferred linear edges of the vortex generators. For example, as can be seen from the indicated cross-section line 6—6, the linear segments 56*a*, 56*b* form the vortex generator edges 46*a*, 46*b*.

It should be noted that the lengths of all the linear segments for the complex dimples 40*b*–40*d* described herein are dependent upon the relationship of the radii of all the spherical sections. Although the spherical sections FIGS. 11–13 have been given equal radii for convenience and clarity of illustration, the spherical sections could also have differing radii. If this were done, the polygon would be irregular. While it is not necessary that the sides of the polygons be the same length, this is preferred since it offers the most aesthetically pleasing appearance.

FIG. 12 shows the third complex dimple 40*c* created by the central spherical section 52*b* being intersected by four peripheral spherical sections 54*d*–54*g*. Specifically, the four outer spherical sections 54*d*–54*g* are symmetrically arranged 90° apart from one another about the center point P of the central spherical section 52*b*. This results in four linear segments 56*d*–56*g* forming a square and four additional linear segments 58*d*–58*g* which project from the apices of the formed square to the intersection of two adjacent outer spherical sections. Any two opposed linear segments of the square (56*d*–56*e* or 56*f*–56*g*) provide the preferred linear edges of the vortex generators and the requisite cross-sectional structure 42. For example, as can once again be seen from the indicated cross-section line 6—6, two of the linear segments 56*d*, 56*e* form the vortex generator edges 46*a*, 46*b*.

FIG. 13 shows the fourth complex dimple 40*d* created by the central spherical section 52*c* being intersected by five outer spherical sections 54*h*–54*l*. Specifically, the five outer spherical sections 54*h*–54*l* are symmetrically arranged 72° apart from one another about the center point P of the central spherical section 52*c*. This results in five linear segments 56*h*–56*l* forming a pentagon and five additional linear segments 58*h*–58*l* which project from the apices of the formed pentagon to the intersection of two adjacent outer spherical sections. Any two non-adjacent linear segments of the pentagon (e.g., 56*h*–56*i*, 56*h*–56*k*, 56*j*–56*l*) provide the preferred linear edges of the vortex generators. For example, as seen from the indicated cross-section line 6—6, two of the linear segments 56*h*, 56*i* form the vortex generator edges 46*a*, 46*b*. Again, the length of the segments is dependent on the relationship of the radii of all of the spherical sections 52*c*, 54*h*–54*l*, and again, in FIG. 13 all the spherical sections have equal radii for convenience.

By incorporating further outer spherical sections around the central section 52*a*–52*c*, it is possible to provide further complex dimples having both the desired cross-sectional structure 42 and central polygons having any number of sides as desired.

Each of the complex dimples 40*a*–40*d* is preferably the same overall size as a conventional dimple. In other words, the complex dimples should be dimensioned to be circumscribed by a circle having the same diameter as a conventional dimple, about 0.100 to 0.185 inches (2.540 to 4.699 mm), with the radii of the circles generated by the intersection of the spherical dimple sections with the sphere of the ball preferably being between about 0.025 to 0.047 inches (0.635 to 1.194 mm) in length. If the complex dimples are dimensioned much wider, the projections 46*a*, 46*b* will become spaced too far apart and their vortex generating characteristics will diminish.

Any combination of the complex dimples 40*a*–40*d* (or further complex dimples made according to the present invention) can placed on the surface 26 of the golf ball 20 to either enhance the performance of the golf ball or to improve the aesthetics of the ball. All the dimples on the golf ball do not need to have vortex generators. Rather, it is anticipated that a uniform disbursement of vortex-generating complex dimples over the surface of the golf ball, intermingled with traditional dimples, will give both the best performance and the best aesthetics. As an example, FIG. 14 shows a polar view of the golf ball 20 with the second and fourth of the above described vortex-generating complex dimples 40*b*, 40*d* interspersed among traditional dimples 22.

Figure 15:
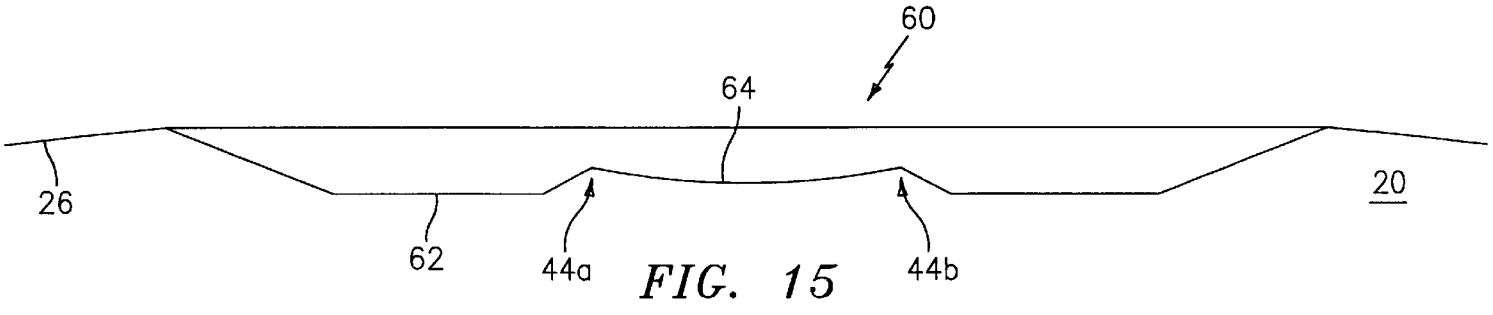
FIGS. 15–20 are cross-sectional views of alternative embodiments of the golf ball dimple shown in FIG. 10.

Turning now to FIGS. 15–20, the dimples of the present invention can be provided with different cross-sectional shapes. For example, FIG. 15 shows a fifth complex dimple 60, generally similar to the first complex dimple 40*a* shown in FIG. 10, comprising a trapezoid-shaped toroidal section 62 intersected by a central spherical section 64 to form the first and second edged projections 44*a*, 44*b* (the "vortex generators"). As should be appreciated, the fifth complex dimple 60 operates in the same manner as the cross-sectional structure shown in FIG. 6. More specifically, the dimple 60 comprises a central depression circumscribed by an annulus whose cross section intersects the central depression in such a manner as to create the projections 44*a*, 44*b* (whose heights are less than the depth of the dimple). Additionally, the cross-sectional structure is such that from any point on the rim of the dimple to the center point of the dimple, the direction of the slope of the dimple wall (the slope being defined with respect to a central axis of the dimple) changes at least twice—once when traversing the toroidal section 62 and once when transitioning from the toroidal section 62 to the central section 64. This feature (the slope changing directions at least twice) is characteristic of the projections 44*a*, 44*b* that extend into the air stream to form air vortices.

Figure 16:
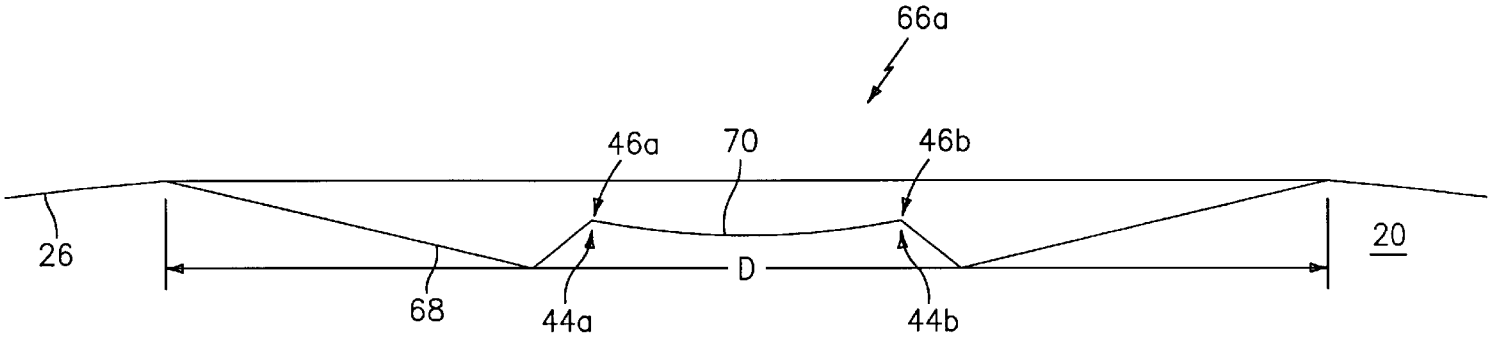
Figure 17:
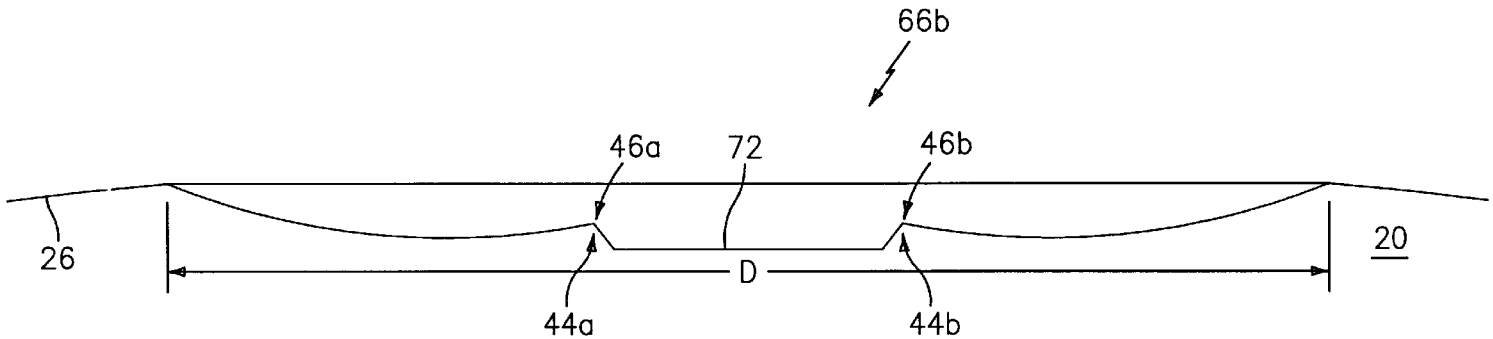
Figure 18:
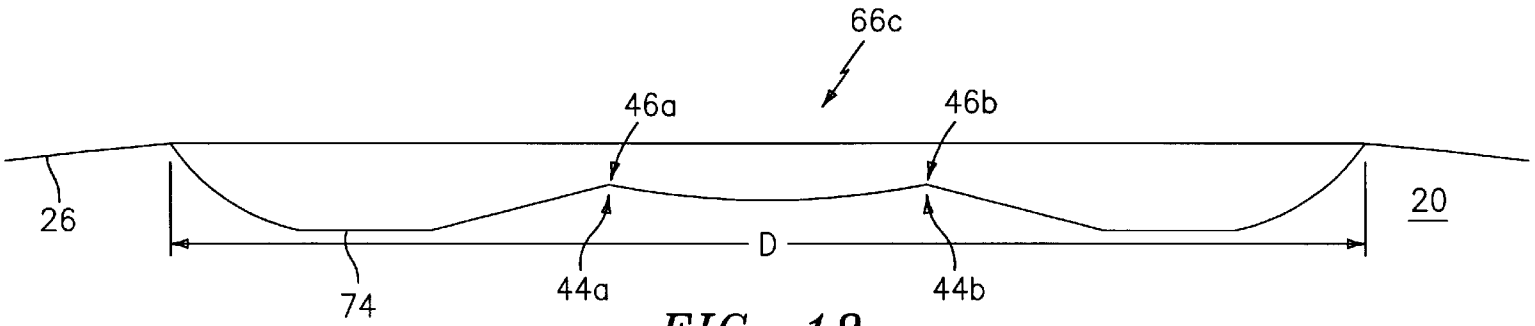
Figure 19:
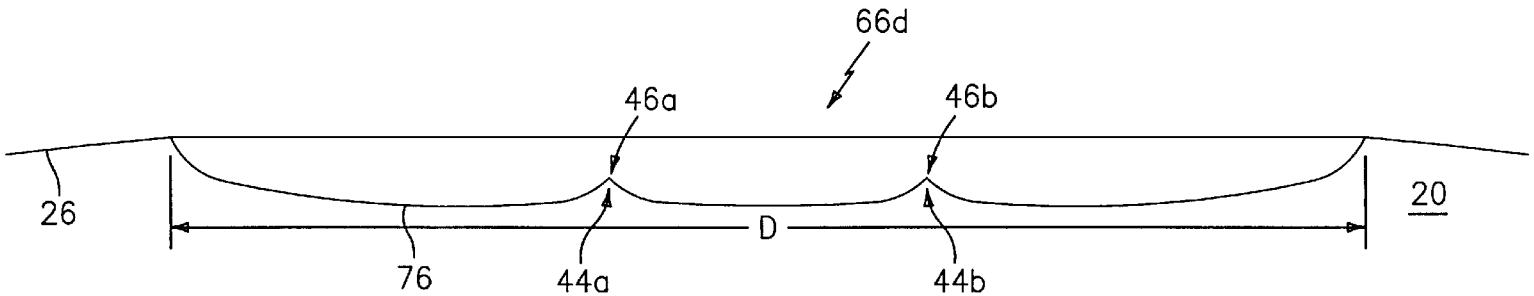
Figure 20:
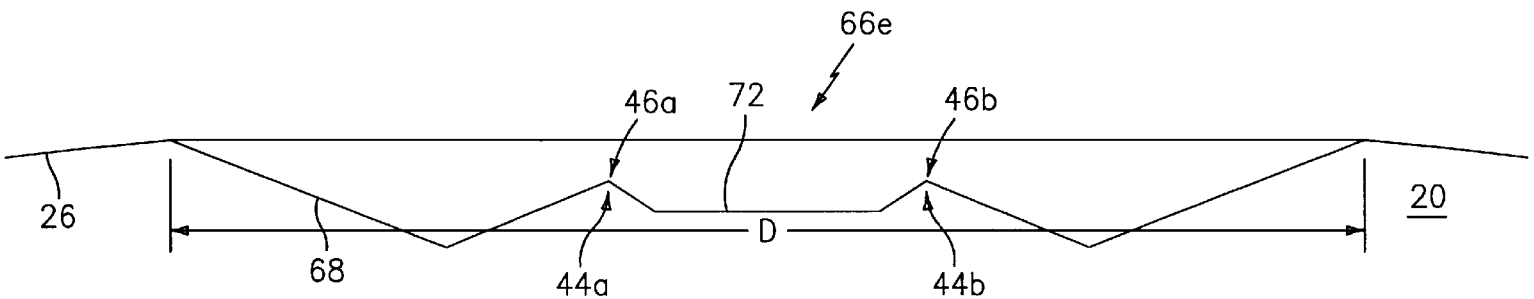

FIGS. 16–20 show additional complex dimples 66*a*–66*e*, respectively. While each dimple 66*a*–66*e* has a different cross-sectional shape, they all have the same general structural characteristics: the protruding projections 44*a*, 44*b*, and the central depression surrounded by an annulus, with the direction of the slope of the dimple wall changing twice when traveling from the rim of the dimple to its center. For example, the sixth complex dimple 66*a*, as shown in FIG. 16, comprises a triangular (in cross section) toroidal section 68 intersected by a spherical section 70. In this embodiment, the direction of the slope of the dimple wall changes at the "bottom" of the triangular section 68, and again when the triangular section 68 transitions into the spherical section 70. Furthermore, the dimples can have: a truncated cone- or pyramid-shaped (i.e., frustoconical or frustopyramidal) central section 72 (FIG. 17); modified triangle- or trapezoid-shaped toroidal sections 74, e.g., a triangle or trapezoid having a curved or spherical outer portion and a frustoconical inner portion extending up to the central section, or vice versa (FIG. 18); irregularly-shaped (e.g., oblong-like) curved walls 76 (FIG. 19); or various combinations of the above (FIG. 20). Of course, the dimples may have other cross-sectional shapes, provided they provide the protruding projections wherein the direction of the slope of the dimple wall changes at least twice when traveling from the rim of the dimple to its center.

Since certain changes may be made in the above described golf ball dimple structures with vortex generators, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. A golf ball defining a spherical outer surface and a plurality of dimples formed in the surface, wherein each of the dimples comprises:

a. a toroidal section defining an outer edge on the spherical outer surface; and b. a spherical section intersecting the toroidal section at about the center of the toroidal section to form a circular ridge lying below a plane defined by the outer edge;

c. wherein the direction of the slope of the dimple, with respect to a central axis of the dimple, changes when traversing the toroidal section and when transitioning from the toroidal section to the spherical section.

2. A golf ball defining a spherical outer surface and a plurality of dimples formed in the surface, wherein each of the dimples comprises:

a. a toroidal section defining an outer edge on the spherical outer surface; and b. a central concave section intersecting the toroidal section at about the center of the toroidal section to form an annular ridge lying below a plane defined by the outer edge;

c. wherein the direction of the slope of the dimple, with respect to a central axis of the dimple, changes when traversing the toroidal section and when transitioning from the toroidal section to the central section.

3. The golf ball of claim 2 wherein the toroidal section is trapezoidal in cross-section.

4. The golf ball of claim 2 wherein the toroidal section is triangular in cross-section.

5. The golf ball of claim 2 wherein the central concave section is spherical.

6. The golf ball of claim 2 wherein the central concave section is frustoconical.

7. The golf ball of claim 2 wherein the central concave section is frustopyramidal.

8. The golf ball of claim 2 wherein the toroidal section comprises:

a. a spherical outer portion extending down from the outer edge; and b. a frustoconical inner portion extending up from the spherical outer portion and intersecting the central concave section.

9. A golf ball defining a spherical outer surface and a plurality of dimples formed in the surface, wherein each of the dimples comprises:

a. a toroidal section defining an outer edge on the spherical outer surface and having an outer annular portion with a negative slope and an inner annular portion with a positive slope, said positive and negative slopes being defined with respect to a central axis of the dimple; and b. a central concave section intersecting the inner annular portion of the toroidal section.

10. The golf ball of claim 9 wherein the toroidal section is trapezoidal in cross-section.

11. The golf ball of claim 9 wherein the toroidal section is triangular in cross-section.

12. The golf ball of claim 9 wherein the central concave section is spherical.

13. The golf ball of claim 9 wherein the central concave section is frustoconical.

14. The golf ball of claim 9 wherein the central concave section is frustopyramidal.

15. The golf ball of claim 9 wherein:

a. the outer annular portion of the toroidal section is spherical; and b. the inner annular portion of the toroidal section is frustoconical.

16. The golf ball of claim 9 wherein the inner and outer annular portions of the toroidal section are frustoconical.

17. The golf ball of claim 9 wherein the inner and outer annular portions of the toroidal section are frustoconical, and the toroidal section further comprises an annular flat bottom connecting the inner and outer annular portions.

* * * * *